United States Patent [19]

Imamura et al.

[11] Patent Number: 4,538,559

[45] Date of Patent: Sep. 3, 1985

[54] ENGINE CAM FOR USE IN INTERNAL COMBUSTION ENGINE

[75] Inventors: Toshio Imamura; Syouzo Kobayashi; Yukihisa Hirano, all of Toyota, Japan

[73] Assignee: Toyota Jidosha Kabushiki Kaisha, Japan

[21] Appl. No.: 527,825

[22] Filed: Aug. 30, 1983

[30] Foreign Application Priority Data

Sep. 3, 1982 [JP] Japan ..... 57-152792

[51] Int. Cl.[3] ..... F01L 1/08

[52] U.S. Cl. ..... 123/90.6; 123/90.27

[58] Field of Search ..... 123/90.27, 90.44, 90.46, 123/90.6

[56] References Cited

U.S. PATENT DOCUMENTS

| | | | |
|---|---|---|---|
| 2,581,233 | 1/1952 | Bishop | 123/90.6 |
| 2,804,863 | 9/1957 | Bensinger et al. | 123/90.6 |
| 3,451,213 | 6/1969 | Lang | 123/90.6 |
| 3,913,538 | 10/1975 | Ableitner | 123/90.46 |
| 4,084,568 | 4/1978 | Sato et al. | 123/90.6 |

FOREIGN PATENT DOCUMENTS

| | | | |
|---|---|---|---|
| 175743 | 8/1953 | Austria | 123/90.6 |
| 2484019 | 12/1981 | Fed. Rep. of Germany | 123/90.6 |
| 21823 | of 1912 | United Kingdom | 123/90.6 |

*Primary Examiner*—Michael Koczo
*Assistant Examiner*—Peggy A. Neils
*Attorney, Agent, or Firm*—Parkhurst & Oliff

[57] ABSTRACT

A cam for use in an overhead-type internal combustion engine which linearly decreases the force holding the valve against the valve seat during the valve closing to valve opening transition, with the cam having lobes for opening the engine valve and a base circle portion for closing the engine valve.

11 Claims, 4 Drawing Figures

ENGINE CAM FOR USE IN INTERNAL COMBUSTION ENGINE

BACKGROUND OF THE INVENTION

The present invention relates to a cam for use in an engine valve system of an internal combustion engine, and more particularly to an engine cam which actuates an engine valve system equipped with a hydraulic valve lash adjuster.

It is common practice in the internal combustion engine art to employ an overhead cam arrangement to increase engine speed and operating efficiency. An overhead camshaft design increases the efficiency of valve train operation since the cam lobes bear directly upon the rocker arms which actuate the intake and exhaust valves, rather than push rods which are employed in conventional valve train arrangements. The removal of the push rods results in a reduction of the reciprocating weight of the engine, thereby increasing the potential RPM of the engine. To ensure quiet operation as well as a relatively long operative life, the tolerances between the various moving parts of an overhead camshaft-type arrangement must be kept within close tolerances. Any increase in the lash between the cam lobes and the follower surfaces on the rocker arms will result in noisy engine operation as will as increased wear of the moving parts.

The use of a valve lash adjuster to reduce the clearance between the arm and the cam, resulting in the elimination of the noisy lash, has become increasingly popular. The lash adjusters operate off of the pressurized engine oil, and the force exerted by the oil on the end of the adjuster plunger increases the mechanical leverage of the rocker arm and forces the cam lobes into contact with the rocker arm at the rocker contact surface. Therefore, the adjuster does not permit any clearance between the rocker arm and the cam.

A valve seated in an inner wall of a cylinder head, is downwardly actuated by the valve stem, which transfers the motion of the cam and rocker arm. This downward actuation is directed against the force of the valve compression spring which upwardly biases the valve toward the valve seat. Consequently, the potential loose contact which may occur between the valve and the valve seat, results in the air-fuel mixture in the combustion chamber of the engine flowing through an exhaust-/intake port at an unscheduled moment.

SUMMARY OF THE INVENTION

The present invention was made in view of the aforementioned background and to overcome the aforementioned drawbacks. It is accordingly an object of this invention to provide an improved engine cam for use in internal combustion engines.

To attain the above objects, a valve train for internal combustion engines of the type having overhead valves, which are actuated by pivoted rocker arm members, which operatively contact a rotating camshaft having cam lobes and a base circle portion thereon, with the modified camshaft located over the rocker members, the improvement comprising:

(a) the modified base circle portion having a configuration whose distance to the base of the circle is gradually decreased from the valve closing point to the valve opening point;

(b) the rocker members having one end thereof contacting an end of one of the valve and having an intermediate portion contacting the cam lobes and base circle portion;

(c) a stationary pivot means attached to the engine with the remaining end of the rocker member operatively connected to the pivot means;

(d) a hydraulic lash adjustment means for controlling the pressure exerted between the rocker arm and the cam and acting as a pivot means for the rocker arm having a port means therein for receiving pressurized fluid from the engine lubricant supply.

BRIEF DESCRIPTION OF THE DRAWINGS

The above objects, features and advantages of the present invention will become more apparent from reading the following description of the preferred embodiment taken in connection with the accompanying drawing, wherein.

DETAILED DESCRIPTION OF THE PREFERRED EMBODIMENT

The present invention is described in detail with reference to the accompanying drawings which illustrate an embodiment of a cam in an overhead cam engine, according to the present invention.

Figure 1:
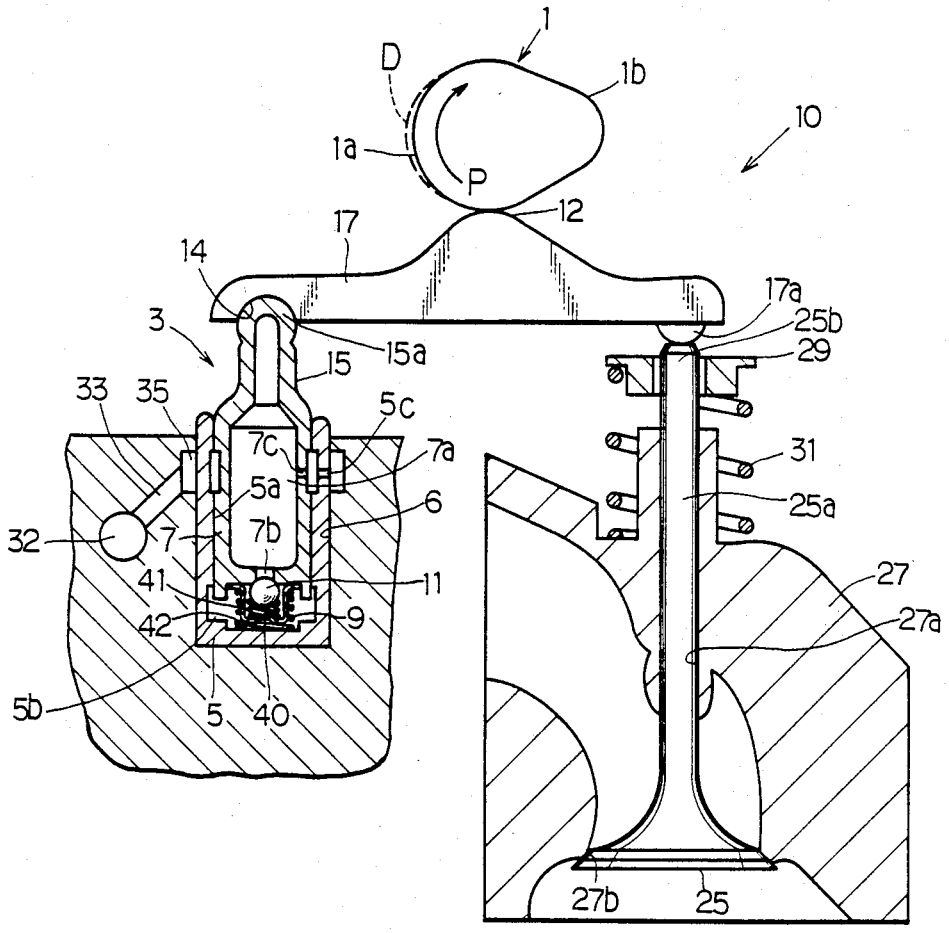
FIG. 1 is a fragmented, cross-sectional view of an internal combustion engine employing a hydraulic valve lash adjuster and an overhead cam of the present invention.

Referring first to FIG. 1, a portion of an overhead cam-type internal combustion engine having a cylinder head 27 is illustrated. Mounted on the cylinder head 27 is a valve train having the general reference 10. The valve train 10 includes a plurality of valves 25 held in a closed position by a plurality of valve springs 31. The valve springs 31 are held in compression between the valve spring retainers 29 and the cylinder head 27. Each valve 25 is opened and closed through the movement of an overhead cam which is mounted in bearings (not shown) and attached to the engine cylinder head 27 in a known manner.

The camshaft 1 comprises lobes **1*b* and a modified base circle portion 1*a*. The cam surfaces of the lobes 1*b* act against a rocker arm 17. A cam follower pad 12 is provided on one side of the rocker arm 17 at an intermediate portion thereof. A contact pad 17*a* is provided on one end of the rocker arm and a pivot recess 14 is provided on the other end of the rocker arm, both of which are on a side opposite to the contact pad 17*a*. The contact pad 17*a* contacts the end of the engine valve stem and the pivot recess 14 contacts a stationary hydraulic lash adjuster 3**.

The stationary lash adjuster 3 is shown as having a body 5, preferably of cylindrical configuration, with a bore **5*a* and a plunger means 7 slidably received in the bore 5*a* in a close fitting relationship. The upper portion of the plunger 7 has an exterior portion 15 which outwardly extends from the body 5, with the end of the plunger having a rounded tip 15*a*. The rounded tip 15*a* is preferably of a spherical radius for pivotally engaging the recess 14 of the rocker arm 17. The lower portion of the plunger 7** has a small hole *7b* provided therein and extending longitudinally therethrough. The lower end of the plunger means 7 forms, in cooperation with the body 5, a chamber *5b* for retaining oil to maintain a specific plunger position needed to adjust the lash. A check ball 11 is provided in the chamber *5b* of the plunger means to permit the one-way flow of oil from the chamber *7a*, defined within the plunger 7, to the chamber *5b* by utilizing the hole *7b*. The ball 11 is movable from its closed position, as shown in FIG. 1, to an opened position which corresponds to the ball being displaced away from the hole *7b*. A cage 40 is placed over the check ball 11 and serves to retain the ball 11 therein. A biasing spring 41 is provided within the cage 40 to urge the check ball 11 into its closed position thereby contacting a valve seat formed at the lower end of the plunger 7 around the hole *7b*. A plunger biasing spring 9 is provided within the chamber *5b* to urge the plunger 7 in a direction away form a blind end 42.

An oil entry port means *5c* is provided on the exterior of the body 5. Further, another oil entry port means *7c* connects the oil port *5c* with the chamber *7a* within the plunger 7. The chamber *7a* connects the port *5c* with an annular groove 35 provided in the cylinder head 27. The groove 35 has connected therewith a suitable oil port 33 which is connected with an oil gallery 32 at the other end which is also provided within the cylinder head 27 of the engine. The oil gallery 32 is connected by suitable passages (not shown) to the engine oil pressure supply system and thus supplies pressurized engine oil to the hydraulic lash adjuster 3.

Figure 2:
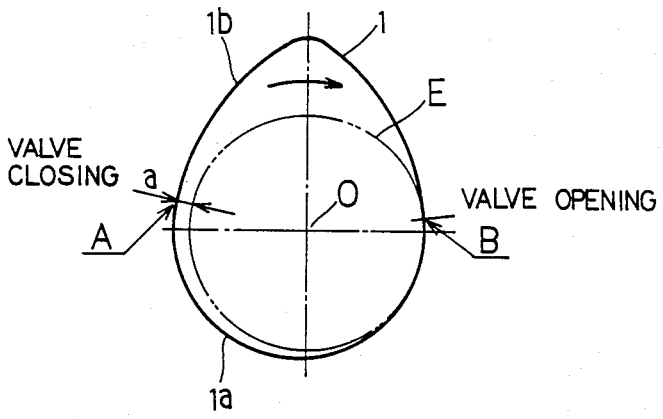
FIG. 2 is a planar view of the overhead cam of the present invention.
Figure 3:
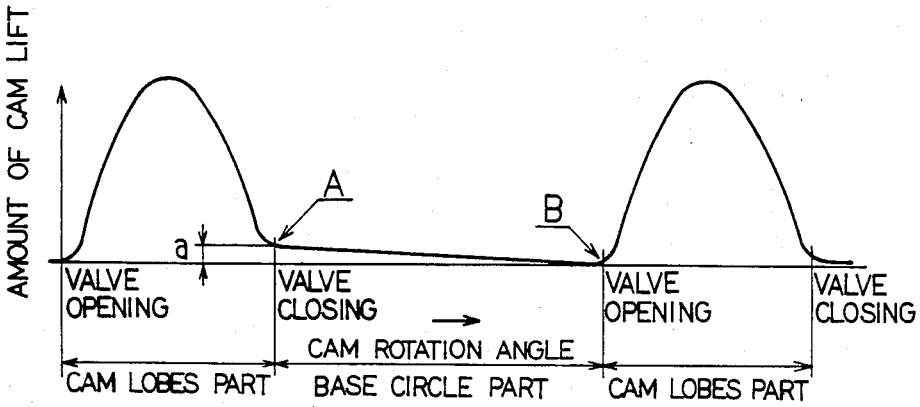
FIG. 3 is a diagram illustrating the change of force biasing an engine valve head toward a valve seat according to the present invention.

Referring next to FIG. 2, the overhead cam of the present invention is illustrated. The configuration of the cam 1 comprises the base circle portion E, generated from a circle having a rotation center O a modified base circle portion *1a* radially extending from the base circle portion E, and the lobes *1b*. The cam is designed so that there is no cam lift when the base circle E and rocker arm are contacted together. The cam is driven in a clockwise direction by the engine as shown by the direction "P" in FIG. 1. The Point "B" in FIG. 3 corresponds to the engine valve 25 beginning to open. When the engine valve 25 is closed, the rocker arm is not displaced. The point "A" in FIG. 3 corresponds to the engine valve 25 being closed. When the engine valve 25 is closed, the value of the cam lift is equal to or less than that of the valve lift loss which is caused by the hydraulic mechanism of the lash adjuster. Therefore, the motion of the cam is not transferred to the engine valve 25 up to a prescribed value of actuation by the cam. During the contact between the cam follower pad 12 of the rocker arm 17 and the lobes *1b*, the engine valves 25 are open the entire time from the point B up to the point A. The amount of distance between the base circle portion E and the modified base circle portion *1a* is gradually and linearly decreased from the point A to the point B along the portion *1a*, as disclosed in FIG. 3.

In operation, as the cam lobes *1b* contact the pad 12 of the rocker arm and assert a force on the pivoted end of the rocker arm 17, the plunger 7 is forced downward, thereby compressing the oil trapped in the chamber *5b*. The check ball 11 prevents unwanted flow of oil from the chamber *5b* to the chamber *7a* and thus prevents further downward movement of the plunger resulting in a stoppage of movement of the rocker arm pivot. When the cam follower pad 12 of the rocker arm is contacted with the modified base circle portion *1a* of the cam 1, the oil is delivered from the gallery 32 through the ports 33, 35, *5c* and *7c* to the chamber *7a* of the plunger 7. Further, when a clearance exists between the recess 14 and the extension portion 15, the oil in the chamber *7a* flows through the small hole *7b* to the chamber *5b*. As a result, the plunger 7 becomes upwardly biased toward the rocker arm because of the fluid pressure in the chamber *5b* and the force of spring 9. Hence, the rounded tip *15a* of the plunger is pressed into the recess 14 of the rocker arm 17, resulting in the rocker arm 17 contacting the cam 1, and the pad *17a* of the arm pressing onto the end *25b* of the valve stem *25a*. Thus, there are no gaps present between the cam 1 and the rocker arm 17, the valve stem end *25b* and the pad *17a* or between the extension portion 15 and the recess 14.

When the lobes *1b* of the cam rotate in a clockwise manner to a position which places them out of contact with the pad 12 on the rocker arm 17, the spring 9 urges the plunger 7 away from the bore end 42, resulting in the rounded tip *15a* of the plunger contacting the recess 14 of the rocker arm 17, thereby pushing the lash adjusted end of the rocker arm 17 upward until the pad 12 contacts the modified base circle portion *1a* of the cam.

Figure 4:
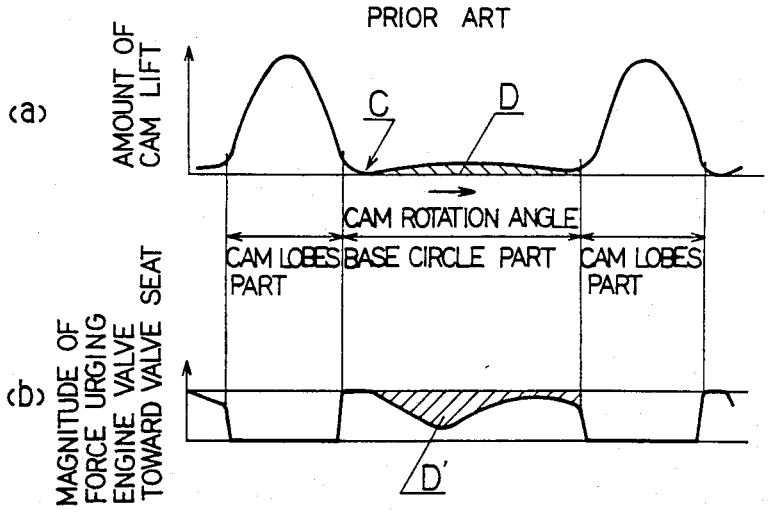
FIG. 4 is a diagram illustrating the change of force biasing an engine valve head toward a valve seat according to prior art.

If the cam 1 is designed with a portion "D" extending from the base circle E, as shown in FIG. 1, the portion "D" of the cam surface applies a downward force on the engine valve 25 against the force of the spring 31. Therefore, the force which biases the engine valve 25 in the closing direction is decreased by a value corresponding to the radial length of the extension D, which is represented by the zone D' in FIG. 4. When the cam follower pad 12 of the rocker arm comes into initial contact with the lobes *1b*, a downward pressure on the rocker arm results in causing a downward movement of the plunger 7 through the body 5. This causes the fluid in the chamber *5b* to become pressurized, resulting in the check ball 11 being urged toward the valve seat of the plunger thereby stopping the fluid flow from the chamber *5b* to the chamber *7a*.

According to the present invention, the modified base circle portion *1a* of the cam modifies the base circle portion E of the cam such that the distance between the base circle portion E and the modified base circle portion *1a* is gradually and linearly decreased from the point "A" where the valve closes, to the point "B" where the valve opens. Therefore, as disclosed in FIG. 3, the magnitude of the force of the spring 31 which pushes the engine valve toward the valve seat is gradually decreased. The length "a", disclosed in FIGS. 2 and 3, corresponds to the radial distance between the circumference of the base circle E and the outer circumference of the cam 1. The length "a" is designed so that it is equal to or less than the amount of lift loss occurring in the lash adjuster 3, thereby modifying the displacement of the cam lift. In this embodiment, the point "B" corresponds to the base circle "E" of the cam 1 being in contact with the cam follower pad 12. The resultant gradual decrease of force upon the valve 25 and the spring 31, effects a tight closing of the engine valve 25 and thereby obviates the problem of loose contact between the valve and the valve seat which could result in an air-fuel mixture in the combustion chamber of the element flowing through an exhaust/intake port at an unscheduled moment.

While the present invention has been described in its preferred embodiment, it is to be understood that the invention is not limited thereto but may be otherwise embodied within the scope of the following claims.

What is claimed is:

1. A valve train for internal combustion engines of the type having overhead valves which are biased into a closed position by a spring biasing means and are actuated by pivoted rocker arm members which operatively contact a rotating camshaft having at least one cam, each cam having cam lobes and a base circle portion thereon, with the camshaft located over the rocker members, the improvement comprising:

said at least one cam being designed so that a radial distance from an outer circumference of the cam to the circumference of the base circle portion is gradually decreased from a valve closing point to a valve opening point, with respect to a rotating direction of the cam, thereby permitting a biasing force exerted by said spring biasing means upon said overhead valve to slowly decrease;

the rocker members having one end thereof contacting an end of the valve and having an intermediate portion contacting the outer circumference of the cam;

a stationary pivot means attached to the engine with the remaining end of the rocker member operatively connected to the pivot means; and an hydraulic lash adjustment means for controlling the pressure exerted between the rocker arm and the cam and acting as a pivot means for the rocker arm, having a port means therein for receiving pressurized fluid from an engine lubricant supply.

2. The valve train of claim 1, wherein an amount of cam lift at the valve closing point is equal to an amount of lift loss occurring in the lash adjustment means.

3. The valve train of claim 1, wherein an amount of cam lift at the valve closing point is less than an amount of lift loss occurring in the lash adjustment means.

4. The valve train of claim 2, wherein the amount of cam lift occurring at the valve opening point is zero.

5. The valve train of claim 3, wherein the amount of cam lift occurring at the valve opening point is zero.

6. A valve train for internal combustion engines of the type having overhead valves which are biased into a closed position by a spring biasing means and are actuated by pivoted rocker arm members which operatively contact a rotating camshaft having at least one cam, each cam having cam lobes and a base circle portion thereon, with the camshaft located over the rocker members, the improvement comprising:

said at least one cam being designed so that a radial distance from an outer circumference of the cam to the circumference of the base circle portion is gradually decreased from a valve closing point to a valve opening point, with respect to a rotating direction of the cam, such that a line passing from the outer circumference of the cam at the valve opening point to the rotation center of the base circle portion is shorter than a continuation of said line from said rotation center of the base circle portion to a point on the outer circumference of the cam which said continuation of said line intersects, thereby permitting a biasing force exerted by said spring biasing means upon said overhead valve to slowly decrease;

the rocker members having one end thereof contacting an end of the valve and having an intermediate portion contacting the outer circumference of the cam;

a stationery pivot means attached to the engine with the remaining end of the rocker member operatively connected to the pivot means; and an hydraulic lash adjustment means for controlling the pressure exerted between the rocker arm and the cam and acting as a pivot means for the rocker arm, having a port means therein for receiving pressurized fluid from an engine lubricant supply.

7. The valve train of claim 6, wherein an amount of cam lift at the valve closing point is equal to an amount of lift loss occurring in the lash adjustment means.

8. The valve train of claim 6, wherein an amount of cam lift at the valve closing point is less than an amount of lift loss occurring in the lash adjustment means.

9. The valve train of claim 7, wherein the amount of cam lift occurring at the valve opening point is zero.

10. The valve train of claim 8, wherein the amount of cam lift occurring at the valve opening point is zero.

11. A valve train for internal combustion engines of the type having overhead valves which are biased into a closed position by a spring biasing means and are actuated by pivoted rocker arm members which operatively contact a rotating camshaft having at least one cam, each cam having cam lobes and a base circle portion thereon, with the camshaft located over the rocker members, the improvement comprising:

said at least one cam being designed so that a radial distance from an outer circumference of the cam to the circumference of the base circle portion is gradually decreased from a valve closing point to a valve opening point, with respect to a rotating direction of the cam, such that a line passing from the outer circumference of the cam at the valve opening point to the rotation center of the base circle portion is shorter than a continuation of said line from said rotation center of the base circle portion to a point on the outer circumference of the cam which said continuation of said line intersects, thereby permitting a biasing force exerted by said spring biasing means upon said overhead valve to slowly decrease;

the rocker members having one end thereof contacting an end of the valve and having an intermediate portion contacting the outer circumference of the cam;

a stationary pivot means attached to the engine with the remaining end of the rocker member operatively connected to the pivot means; and an hydraulic lash adjustment means for controlling the pressure exerted between the rocker arm and the cam and acting as a pivot means for the rocker arm, having a port means therein for receiving pressurized fluid from an engine lubricant, wherein the amount of cam lift occurring at the valve opening point is zero.

* * * * *